US008162448B2

(12) United States Patent
Miyata

(10) Patent No.: US 8,162,448 B2
(45) Date of Patent: Apr. 24, 2012

(54) LIQUID EJECTION HEAD AND MANUFACTURING METHOD THEREOF

(75) Inventor: Yoshinao Miyata, Matsukawa (JP)

(73) Assignee: Seiko Epson Corporation, Tokyo (JP)

( * ) Notice: Subject to any disclaimer, the term of this patent is extended or adjusted under 35 U.S.C. 154(b) by 466 days.

(21) Appl. No.: 12/371,448

(22) Filed: Feb. 13, 2009

(65) Prior Publication Data

US 2009/0207212 A1 Aug. 20, 2009

(30) Foreign Application Priority Data

Feb. 15, 2008 (JP) ..... 2008-035189

(51) Int. Cl.
*B41J 2/045* (2006.01)

(52) U.S. Cl. ..... 347/68

(58) Field of Classification Search ..... 347/68, 347/70–72

See application file for complete search history.

(56) References Cited

FOREIGN PATENT DOCUMENTS

| | | | |
|---|---|---|---|
| JP | 07-132595 | A | 2/1995 |
| JP | 2002-313754 | A | 10/2002 |
| JP | 2003-011365 | A | 1/2003 |
| JP | 2006-218716 | A | 8/2006 |
| JP | 2007-098813 | A | 4/2007 |
| JP | 2007-194373 | A | 8/2007 |

*Primary Examiner* — Matthew Luu
*Assistant Examiner* — Lisa M Solomon
(74) *Attorney, Agent, or Firm* — Kilpatrick Townsend & Stockton LLP

(57) ABSTRACT

A liquid ejection head includes a flow channel-forming substrate having a plurality of pressure-generating chambers communicated with nozzles for ejecting droplets, the pressure-generating chambers being arranged in parallel with each other; a plurality of pressure-applying units for applying pressure to interiors of the pressure-generating chambers; and a joining substrate joined onto one surface of the flow channel-forming substrate. The flow channel-forming substrate includes a silicon single crystal substrate having a (110) plane orientation and has a side surface extending in a longitudinal direction of the pressure-generating chambers, the side surface being composed of a first (111) plane perpendicular to a (110) plane. The joining substrate includes a silicon single crystal substrate having a (110) plane orientation and is joined onto the flow channel-forming substrate so that a first (111) plane of the joining substrate perpendicular to the (110) plane intersects the first (111) plane of the flow channel-forming substrate.

2 Claims, 9 Drawing Sheets

LIQUID EJECTION HEAD AND MANUFACTURING METHOD THEREOF

BACKGROUND

1. Technical Field

The present invention generally relates to liquid ejection heads that eject droplets from nozzles and methods of manufacturing the liquid ejection heads. In particular, the invention relates to an ink jet recording head that ejects ink droplets and a method of manufacturing the ink jet recording head.

2. Related Art

An ink jet recording head that ejects ink droplets is a representative example of a liquid ejection head that ejects droplets. One example of the ink jet recording head includes a nozzle plate with nozzles perforated therein, a flow channel-forming substrate in which a plurality of pressure-generating chambers communicated with the nozzles are formed, a piezoelectric element serving as a pressure-generating unit and being disposed at one side of the flow channel-forming substrate, and a reservoir-forming substrate (protective substrate) having a reservoir portion communicated with the plurality of pressure-generating chambers and being joined onto the flow channel-forming substrate (e.g., refer to Japanese Unexamined Patent Application Publication No. 2007-98813).

The flow channel-forming substrate of such an ink jet recording head is, for example, formed of a silicon single crystal substrate having a (110) plane orientation, and the pressure-generating chambers (ink flow channel) are formed by anisotropically etching the silicon single crystal substrate. To be more specific, the pressure-generating chambers are formed by anisotropically etching a silicon single crystal substrate such that side surfaces extending in the longitudinal direction are composed of a first (111) plane perpendicular to a (110) plane and that side surfaces extending in the width direction (transversal direction) are composed of a second (111) plane intersecting the first (111) plane.

In the case where a flow channel-forming substrate is formed of a silicon single crystal substrate having a (110) plane orientation, a reservoir-forming substrate is usually also formed of a silicon single crystal substrate having a (110) plane orientation. Since the reservoir portion is formed to align with the pressure-generating chambers, side surfaces of the reservoir portion that extend in the width direction (the longitudinal direction of the pressure-generating chambers) are composed of a first (111) plane and side surfaces that extend in the longitudinal direction are composed of a plane including a second (111) plane.

This means that the flow channel-forming substrate is joined onto the reservoir-forming substrate while having the first (111) planes of both substrates oriented in the same direction.

A (110) silicon single crystal substrate used as a flow channel-forming substrate or a reservoir-forming substrate is susceptible to cracking along the first (111) plane. If the first (111) plane of the flow channel-forming substrate is oriented in the same direction as the first (111) plane of the reservoir-forming substrate, cracks may occur along the first (111) planes even when the flow channel-forming substrate and the reservoir-forming substrate are joined together.

In general, in forming the flow channel-forming substrate or the reservoir-forming substrate, a silicon wafer in which a plurality of flow channel-forming substrates or reservoir-forming substrates are collectively formed is prepared and diced along a break pattern. The break pattern is constituted by, for example, a plurality of through holes that form dicing lines and fragile portions between the holes (e.g., refer to Japanese Unexamined Patent Application Publication Nos. 2006-218716 and 2002-313754).

The through holes constituting the break pattern are usually formed by anisotropically etching the silicon wafer, as with formation of the pressure-generating chambers. Thus, through holes can rarely be formed into a straight line along the dicing line in a direction intersecting the first or second (111) plane. The width of the break pattern thereby becomes relatively large. If the width of the break pattern is large, the number of flow channel-forming substrates or the reservoir-forming substrates that can be formed on one silicon wafer decreases, resulting in an increase in cost. The width of the break pattern is preferably as small as possible.

In forming a flow channel-forming substrate having pressure-generating chambers or a reservoir-forming substrate having a reservoir portion as described above, a break pattern is formed in a direction along the first (111) plane and in a direction orthogonal to this direction. The break pattern extending in such directions can be formed to have a relatively small width. Accordingly, the flow channel-forming substrate has been joined with the reservoir-forming substrate so that their first (111) planes are oriented in the same direction. In other words, the reservoir portion of the reservoir-forming substrate has side surfaces that extend in the width direction (the longitudinal direction of the pressure-generating chambers) and are composed of the first (111) plane, and side surfaces that extend in the longitudinal direction and are composed of planes including a second (111) plane.

As described in Japanese Unexamined Patent Application Publication No. 2007-98813, in forming such a reservoir portion by anisotropic etching, a correction pattern having a particular shape is provided in side surface portions extending in the longitudinal direction of the reservoir portion so that the side surfaces in the longitudinal direction of the reservoir portion are formed into a straight line. However, the shape of the side surfaces of the reservoir portion is difficult to accurately control through the correction pattern. Moreover, since regions for forming the correction patterns are needed, the number of substrates that can be produced from one wafer decreases.

It should be noted that the problem of substrates' susceptibility to cracking is not unique to ink jet recording heads that eject ink droplets but is present in other types of liquid ejection heads that eject droplets other than ink droplets.

SUMMARY

An advantage of some aspects of the invention is that a liquid ejection head in which substrate cracking can be prevented and the reservoir portion can be formed highly accurately and a method of manufacturing such a liquid ejection head are provided.

One aspect of the invention provides a liquid ejection head that includes a flow channel-forming substrate having a plurality of pressure-generating chambers communicated with nozzles configured to eject droplets, the plurality of pressure-generating chambers being arranged in parallel with each other; a plurality of pressure-applying units configured to apply pressure to interiors of the pressure-generating chambers; and a joining substrate joined onto one surface of the flow channel-forming substrate. The flow channel-forming substrate includes a silicon single crystal substrate having a (110) plane orientation and has a side surface extending in a longitudinal direction of the pressure-generating chambers, the side surface being composed of a first (111) plane perpendicular to a (110) plane. The joining substrate includes a silicon single crystal substrate having a (110) plane orientation and is joined onto the flow channel-forming substrate so that a first (111) plane of the joining substrate perpendicular to the (110) plane intersects the first (111) plane of the flow channel-forming substrate.

According to this structure, the direction in which cracking easily occurs in the substrate differs between the flow channel-forming substrate and the joining substrate when they are joined. Thus, the rigidity as a whole can be substantially improved, and cracking of each substrate can be suppressed.

The first (111) plane of the joining substrate is preferably orthogonal to the first (111) plane of the flow channel-forming substrate to more reliably prevent cracking of the flow channel-forming substrate and the joining substrate.

The joining substrate is prefearbly a reservoir-forming substrate having a reservoir portion communicated with each of the plurality of pressure-generating chambers, the reservoir portion extending in a direction in which the pressure-generating chambers are arranged. A side surface of the reservoir portion that extends in a longitudinal direction of the reservoir portion is preferably composed of a second (111) plane perpendicular to the first (111) plane. In this manner, the substrate cracking can be more reliably prevented and the reservoir portion can be highly accurately formed.

Another aspect of the invention provides a method of manufacturing a liquid ejection head that includes a flow channel-forming substrate including a silicon single crystal substrate having a (110) plane orientation, the flow channel-forming substrate having a plurality of pressure-generating chambers communicated with nozzles configured to eject droplets, the plurality of pressure-generating chambers being arranged in parallel with each other; a plurality of pressure-generating units configured to apply pressure to interiors of the plurality of pressure-generating chambers; and a reservoir-forming substrate including a silicon single crystal substrate having a (110) plane orientation, the reservoir-forming substrate having a reservoir portion communicated with each of the plurality of pressure-generating chambers, the reservoir portion extending in a direction in which the pressure-generating chambers are arranged, the reservoir-forming substrate being joined onto one surface of the flow channel-forming substrate. This method includes (a) anisotropically etching a first wafer, having a plurality of flow channel-forming substrates collectively formed therein, to form the pressure-generating chambers having side faces that extend in a longitudinal direction of the pressure-generating chambers and are composed of a first (111) plane perpendicular to a (110) plane of the first wafer; and anisotropically etching a second wafer, having a plurality of reservoir-forming substrates collectively formed therein, to form the reservoir portion having side faces that extend in a longitudinal direction of the reservoir portion and are composed of a first (111) plane perpendicular to a (110) plane of the second wafer; (b) joining the first wafer onto the second wafer so that the first (111) plane of the first wafer intersects the first (111) plane of the second wafer; and (c) dicing the first wafer and the second wafer into individual flow channel-forming substrates and reservoir-forming substrates. According to this method, the cracking of the flow channel-forming substrate and the reservoir-forming substrate can be more reliably prevented, and the reservoir portion can be highly accurately formed.

Preferably, one of orientation flats of the first wafer and the second wafer extends along a (111) plane while the other extends along a (112) plane. In this manner, the cracking of the flow channel-forming substrate and the reservoir-forming substrate can be more reliably prevented, and the reservoir portion can be highly accurately formed.

In the process of (c) described above, a laser beam is preferably applied on the first wafer and the second wafer while the laser beam is being focused to a point inside the first and second wafers to form fragile portions having a predetermined width in the first and second wafers and to form a connecting portion in a surface layer onto which the laser beam is applied, and external force is preferably applied to dice the first and second wafers along the fragile portions. According to this method, the dicing width can be made smaller than in the case where a break pattern is formed.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
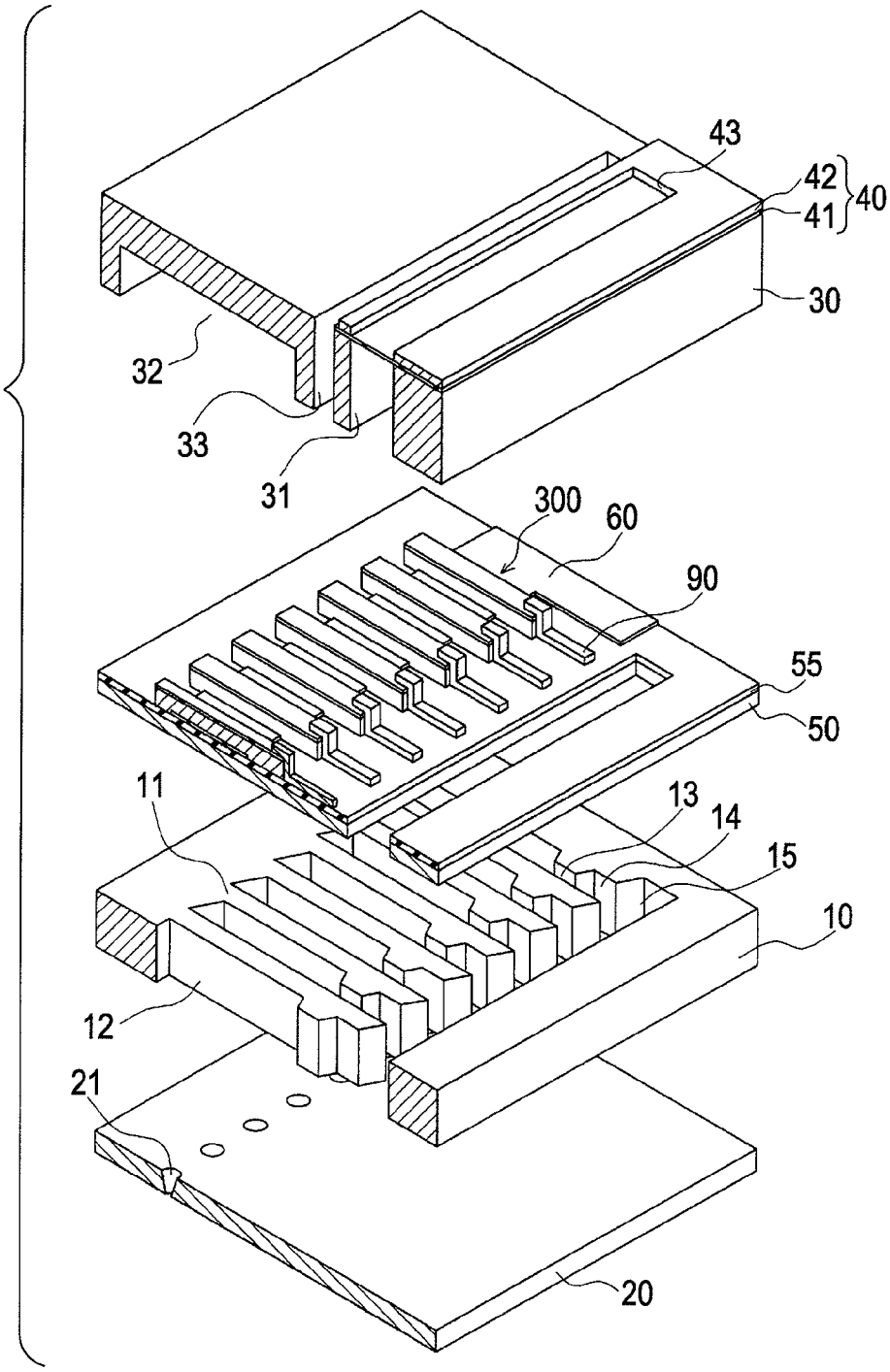
FIG. 1 is an exploded perspective view of a recording head according to one embodiment.
Figure 2A:
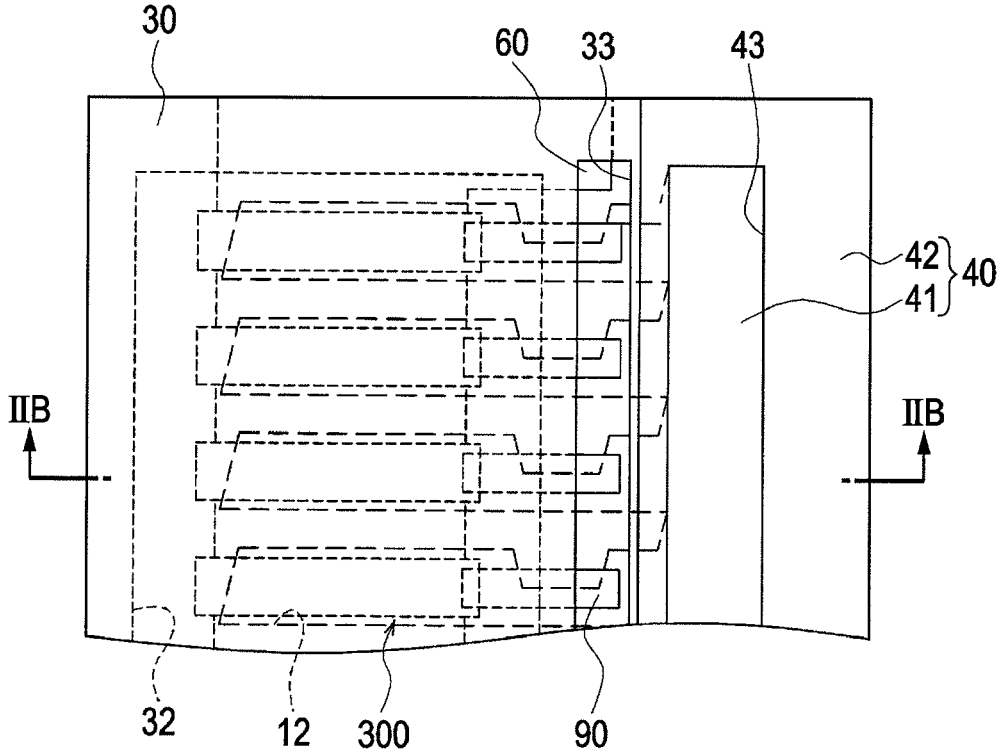
FIG. 2A is a plan view of one embodiment of the recording head.
Figure 2B:
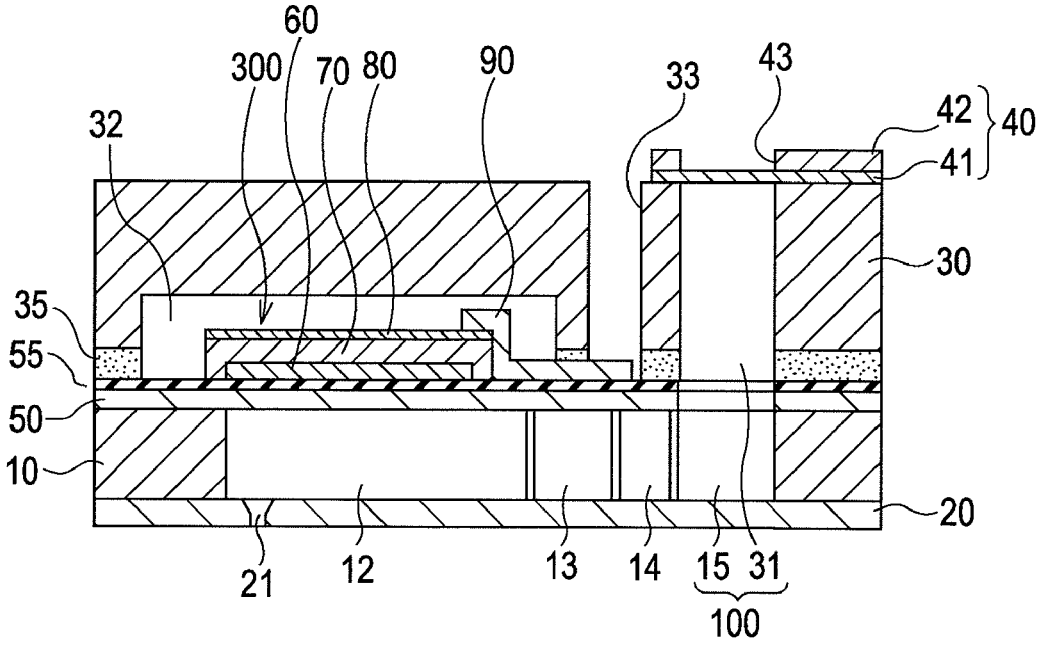
FIG. 2B is a cross-sectional view taken along line IIB-IIB of FIG. 2A.
Figure 3:
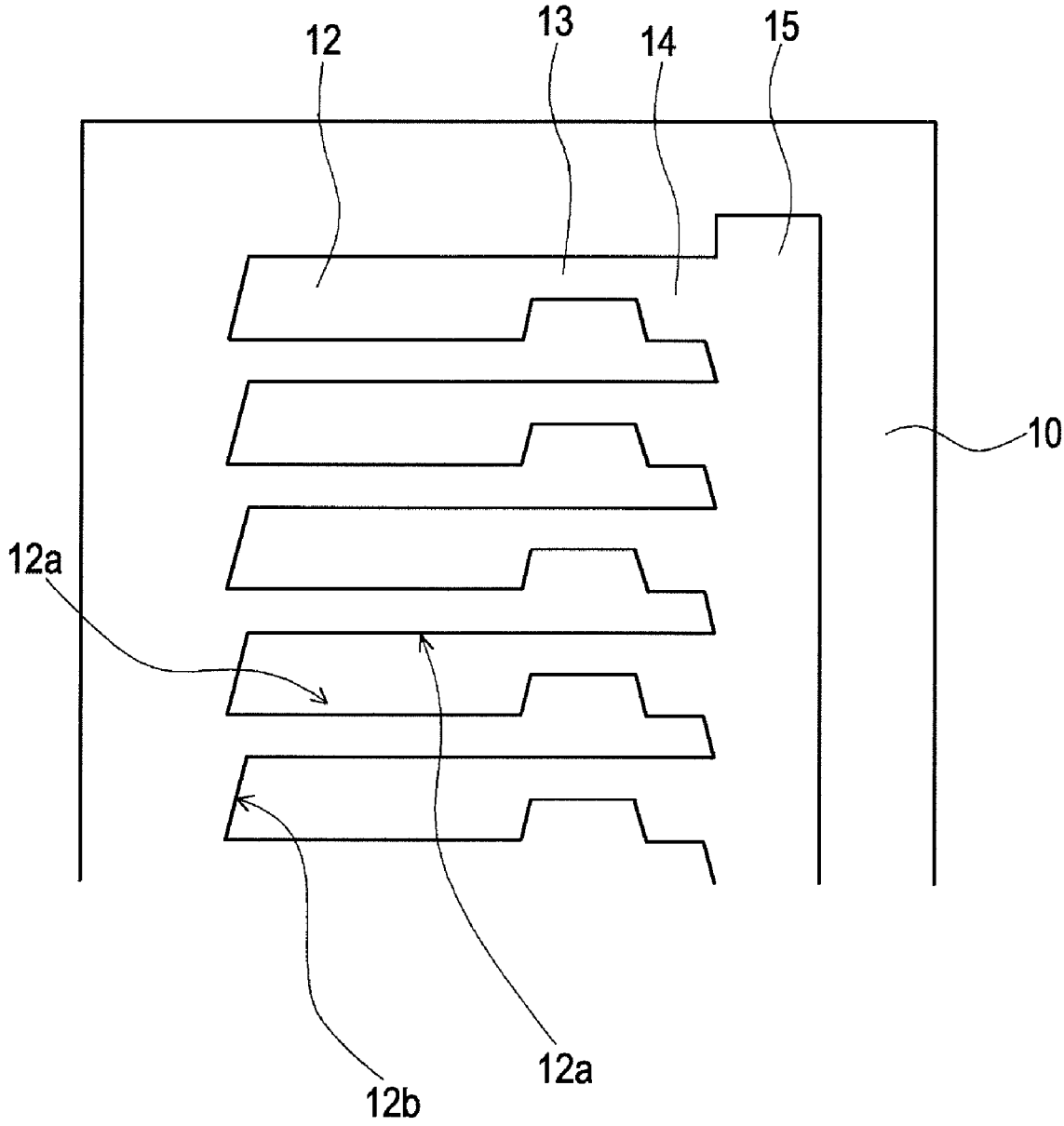
FIG. 3 is a plan view of a flow channel-forming substrate according to one embodiment.
Figure 4:
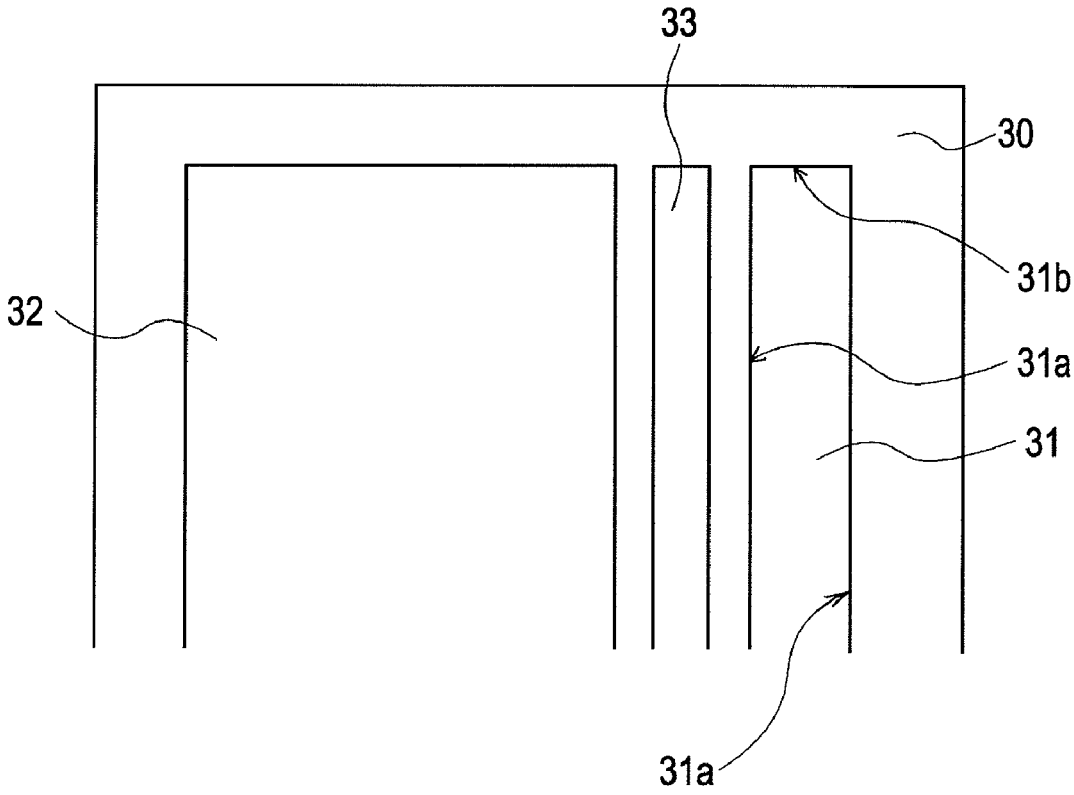
FIG. 4 is a plan view of a reservoir-forming substrate according to one embodiment.

Embodiments of the invention will now be described in detail. FIG. 1 is an exploded perspective view of an ink jet recording head manufactured by a method according to one embodiment of the invention. FIG. 2A is a partial plan view of the recording head shown in FIG. 1, and FIG. 2B is a cross-sectional view taken along line IIB-IIB of FIG. 2A. FIG. 3 is a plan view of a flow channel-forming substrate. FIG. 4 is a plan view of a reservoir-forming substrate.

A flow channel-forming substrate 10 is a silicon single crystal substrate having a (110) plane orientation. An elastic film 50 made of an oxide film is formed on one surface of the flow channel-forming substrate 10, as shown in the drawing. The flow channel-forming substrate 10 has a plurality of pressure-generating chambers 12 defined by dividing walls 11. The pressure-generating chambers 12 are arranged parallel to each other in the width direction (transverse direction) of the flow channel-forming substrate 10. The dividing walls 11 also define ink supply paths 13 each communicated with a corresponding pressure-generating chamber 12, and communication paths 14. The ink supply paths 13 and the communication paths 14 are formed at one side of the pressure-generating chambers 12 of the flow channel-forming substrate 10 in the longitudinal direction of the pressure-generating chamber 12. A communication portion 15 communicated with each of the communication paths 14 is provided at the outer side of the communication paths 14. The communication portion 15 is a part of a reservoir 100 that serves as a common ink reservoir (liquid chamber) for all the pressure-generating chambers 12. The communication portion 15 is communicated with a reservoir portion 31 of a reservoir-forming substrate 30 described below.

The ink supply paths 13 each have a cross-sectional area smaller than that of the pressure-generating chamber 12 to maintain the flow channel resistance of ink flowing from the communication portion 15 to the pressure-generating chamber 12 constant. For example, in this embodiment, the ink supply path 13 having a width smaller than that of the pressure-generating chamber 12 is formed by narrowing part of the flow channel at the pressure-generating chamber 12 side between the reservoir 100 and the pressure-generating chamber 12. Although the ink supply path 13 of this embodiment is formed by narrowing the flow channel from one side, the ink supply path 13 may alternatively be formed by narrowing the flow channel from both sides. The ink supply path 13 may be formed by decreasing the height of the flow channel instead of decreasing the width of the flow channel.

Each communication path 14 is formed by extending the dividing walls 11 of the corresponding pressure-generating chamber 12 at the both sides in the width direction toward the communication portion 15-side so as to divide the space between the ink supply path 13 and the communication portion 15.

The ink flow channels such as pressure-generating chambers 12, the ink supply paths 13, the communication paths 14, and the communication portion 15 are formed by anisotropically etching the flow channel-forming substrate 10, the detailed description of which is provided below. As shown in FIG. 3, side surfaces 12*a* extending in the longitudinal direction of the pressure-generating chamber 12 are composed of first (111) planes perpendicular to (110) planes of the flow channel-forming substrate (silicon single crystal substrate) 10. Side surfaces 12*b* extending in the width direction are composed of second (111) planes intersecting the first (111) planes.

A nozzle plate 20 with a plurality of nozzles 21 perforated therein is joined onto the opening surface-side of the flow channel-forming substrate 10. Each nozzle 21 is communicated with an end portion of the corresponding pressure-generating chamber 12 remote from the ink supply path 13. The nozzle plate 20 is composed of, for example, a metal material such as stainless steel. Alternatively, the nozzle plate 20 may be formed of other materials, such as glass ceramic, silicon single crystal substrate, etc.

The elastic film 50 is formed at the side of the flow channel-forming substrate 10 opposite to the opening surface, as described above. An insulating film 55 composed of an oxide material different from that of the elastic film 50 is formed on the elastic film 50. Piezoelectric elements 300 functioning as pressure-generating units and each including a lower electrode film 60, a piezoelectric film 70, and an upper electrode film 80 are disposed on the insulating film 55. The piezoelectric element 300 is not limited to a unit having the lower electrode film 60, the piezoelectric film 70, and the upper electrode film 80. The piezoelectric element 300 may be a unit that at least includes the piezoelectric film 70. In general, one of the electrodes of each piezoelectric element 300 is formed as a common electrode. The other electrode is formed as an individual electrode by patterning together with the piezoelectric film 70 so that one individual electrode and one piezoelectric film 70 is provided for every pressure-generating chamber 12. In the example described above, the elastic film 50, the insulating film 55, and the lower electrode film 60 substantially function as diaphragms. Alternatively, the elastic film 50 and the insulating film 55 may be omitted, and only the lower electrode film 60 may be formed so that the lower electrode film 60 functions as a diaphragm. The piezoelectric element 300 itself may substantially function as a diaphragm also.

A lead electrode 90 composed of gold (Au) or the like is connected to the upper electrode film 80 of each piezoelectric element 300. Voltage is selectively applied to the piezoelectric element 300 through this lead electrode 90.

A reservoir-forming substrate 30 is joined onto the flow channel-forming substrate 10 on which the piezoelectric elements 300 are formed. The reservoir-forming substrate 30 is a joining substrate having a reservoir portion 31 constituting at least part of the reservoir 100 in which ink to be supplied to the pressure-generating chamber 12 is stored. The reservoir-forming substrate 30 is joined onto the flow channel-forming substrate 10 with an adhesive layer 35. The reservoir portion 31 penetrates the reservoir-forming substrate 30 in the thickness direction and is formed as a continuous space that extends in the direction in which the pressure-generating chambers 12 are aligned. As described above, the reservoir portion 31 is communicated with the communication portion 15, and the reservoir portion 31 and the communication portion 15 constitute the reservoir 100.

A piezoelectric element holder 32 for protecting the piezoelectric elements 300 is formed in the reservoir-forming substrate 30. The interior of the piezoelectric element holder 32 may be unsealed or hermetically sealed.

A through hole 33 that penetrates the reservoir-forming substrate 30 in the thickness direction is formed in the reservoir-forming substrate 30. End portions of the lead electrodes 90 extracted from the piezoelectric elements 300 and part of the lower electrode film 60 are exposed in the through hole 33. Although not shown in the drawing, the lead electrodes 90 and the lower electrode film 60 are electrically connected to a driving IC or the like for driving the piezoelectric elements 300 via interconnecting wires extending in the through hole 33.

The reservoir-forming substrate 30 is a silicon single crystal substrate having a (110) plane orientation, which is the same material as that of the flow channel-forming substrate 10. As described below, the reservoir portion 31 is formed by anisotropically etching the reservoir-forming substrate 30. As shown in FIG. 4, side surfaces 31*a* that extend in the longitudinal direction (the direction in which the pressure-generating chambers 12 are aligned) are composed of first (111) planes perpendicular to (110) planes of the reservoir-forming substrate 30, and side surfaces 31*b* extending in the width direction are composed of planes including second (111) planes intersecting the first (111) planes. In particular, the side surfaces 31*b* are mainly composed of second (111) planes.

A compliance substrate 40 including a sealing film 41 and a fixing plate 42 is joined onto the reservoir-forming substrate 30. The sealing film 41 disposed at the reservoir-forming substrate 30-side is composed of a low-rigidity material that deforms by changes in pressure inside the reservoir 100, e.g., an elastic material. The fixing plate 42 is provided to fix the sealing film 41 and is composed of a hard material such as a metal or the like. The part of the fixing plate 42 opposing the reservoir 100 is completely removed in the thickness direction to form an opening 43. One side of the reservoir 100 is sealed with the flexible sealing film 41 only. In other words, the space inside the opening 43 serves as a flexible portion that deforms by changes in inner pressure of the reservoir 100. The pressure inside the reservoir 100 is maintained at a constant value as the flexible part (sealing film 41) of the compliance substrate 40 deforms.

According to the ink jet recording head of this embodiment, ink is taken in from an ink inlet connected to an external link supply unit (not shown) to fill the interior, i.e., the reservoir 100, the nozzles 21, etc., with the ink. Subsequently, in response to a recording signal from a driving IC (not shown), voltage is applied to each piezoelectric element 300 corresponding to the pressure-generating chamber 12. As the piezoelectric elements 300 under application of voltage undergo flexural deformation, the pressure inside each pressure-generating chamber 12 increases, and ink droplets are ejected from the nozzles 21.

Figure 5A:
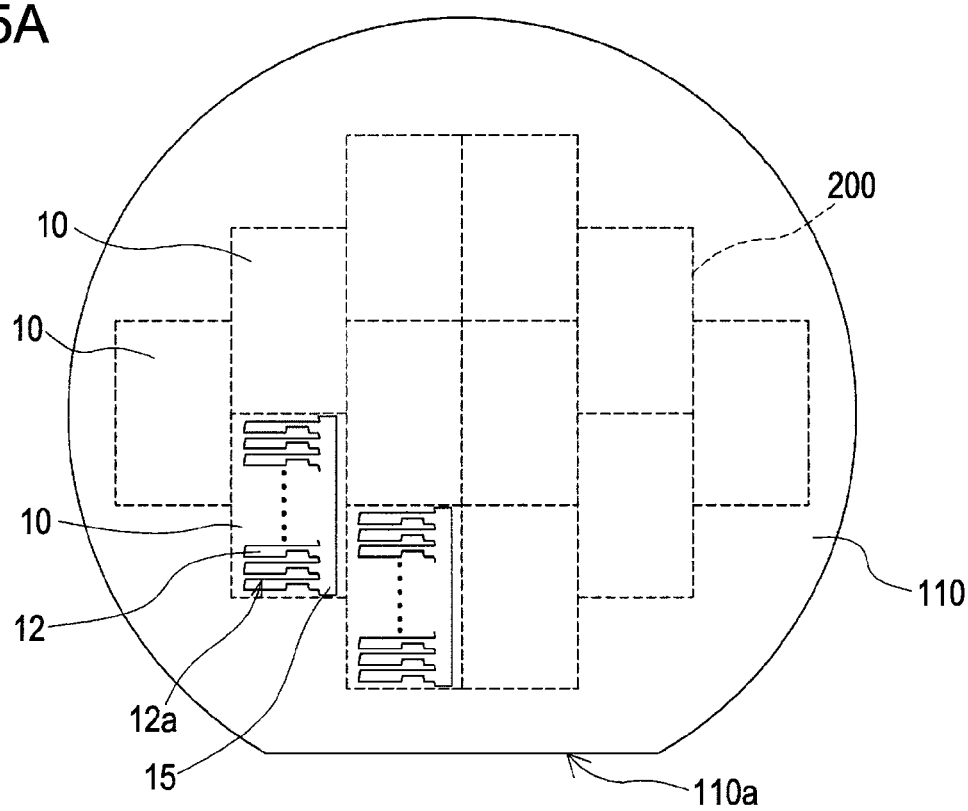
FIG. 5A is a plan view of a wafer for forming flow channel-forming substrates and FIG. 5B is a plan view of a wafer for forming reservoir-forming substrates.
Figure 5B:
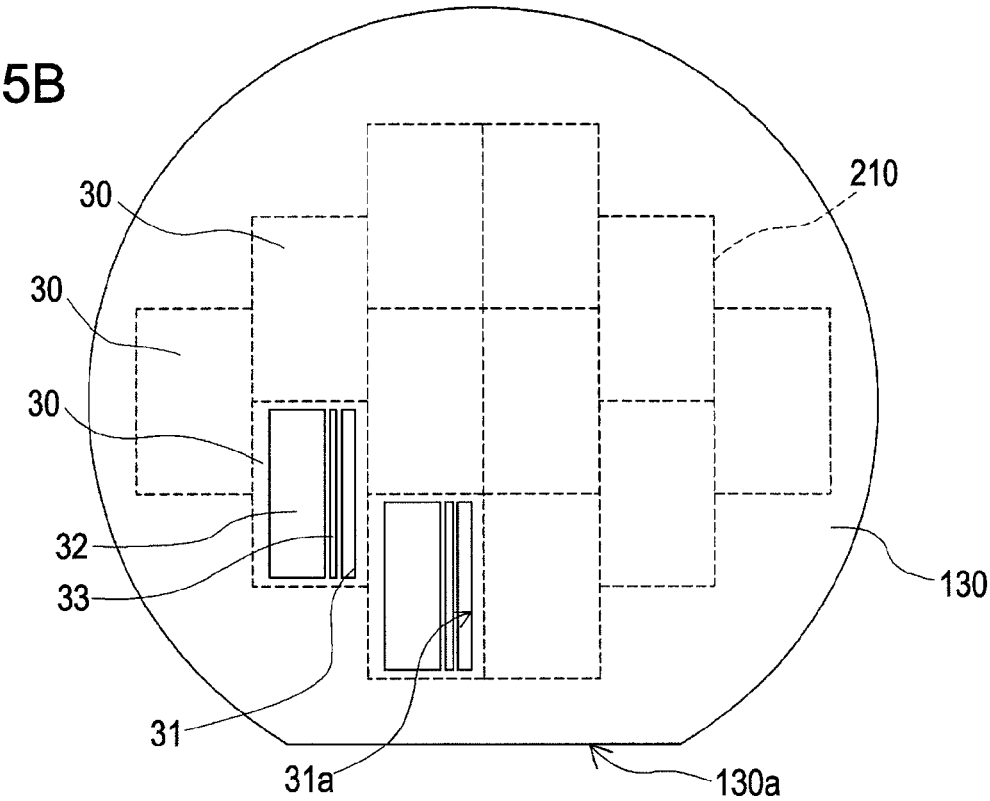

A method of manufacturing such an ink jet recording head will now be described with reference to FIGS. 5A to 9C. FIG. 5A is a plan view of a wafer for forming flow channel-forming substrates 10 (this wafer is referred to as "first wafer" hereinafter) and FIG. 5B is a plan view of a wafer for forming reservoir-forming substrates 30 (this wafer is referred to as "second wafer" hereinafter). FIGS. 6A to 8C are each a cross-sectional view of a pressure-generating chamber 12 taken in the longitudinal direction. FIGS. 9A to 9C are schematic views illustrating a process of cutting a wafer.

A plurality of flow channel-forming substrates 10 or reservoir-forming substrates 30 of the ink jet recording head described above are formed integrally on one silicon wafer having a (110) plane orientation, and then the wafer is diced along a dicing line to separate individual flow channel-forming substrates 10 or the reservoir-forming substrates 30. For example, as shown in FIG. 5A, a plurality of flow channel-forming substrates 10 are integrally formed in a first wafer 110 for forming flow channel-forming substrates, the first wafer 110 being a 6-inch silicon wafer, for example. In other words, pressure-generating chambers 12 and other associated components are formed in the first wafer 110. Subsequently, the first wafer 110 is diced along dicing lines 200 shown in the drawing to separate the flow channel-forming substrates 10.

As shown in FIG. 5B, a plurality of reservoir-forming substrates 30 are also integrally formed in a second wafer 130 for forming reservoir-forming substrates, the second wafer 130 being a 6-inch silicon wafer, for example. In other words, the second wafer 130 is anisotropically wet-etched to form the reservoir portions 31 and other associated parts. Subsequently, the second wafer 130 is diced along dicing lines 210 shown in the drawing to separate the reservoir-forming substrates 30.

The first wafer 110 and the second wafer 130 are silicon wafers having a (110) plane orientation but their orientation-flat surfaces have different crystal orientations. In other words, an orientation flat 110*a* of the first wafer 110 is formed along a first (111) plane perpendicular to a (110) plane, whereas an orientation flat 130*a* of the second wafer 130 is formed along a (112) plane perpendicular to a (110) plane. The direction orthogonal to the orientation flat 130*a* is the direction along the first (111) plane.

The ink jet recording head is manufactured as described below by using the first wafer 110 and the second wafer 130.

Figure 6A:
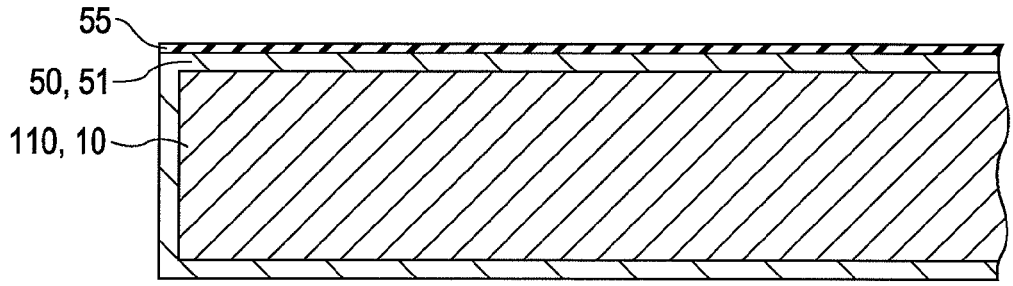
FIGS. 6A to 6D are cross-sectional views showing a manufacturing process according to one embodiment.

First, piezoelectric elements 300 are formed on the first wafer 110. In particular, as shown in FIG. 6A, an oxide film 51 that forms the elastic film 50 is formed on a surface of the first wafer 110, and an insulating film 55 composed of an oxide material different from that of the elastic film 50 is formed on the elastic film 50 (oxide film 51).

Figure 6B:
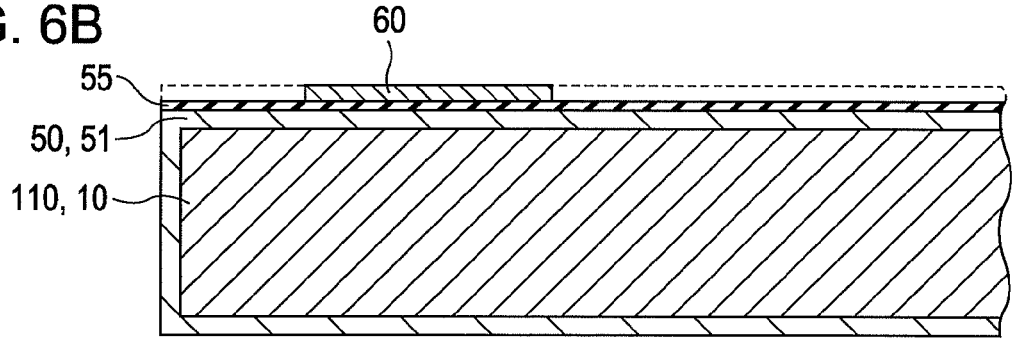
Figure 6C:
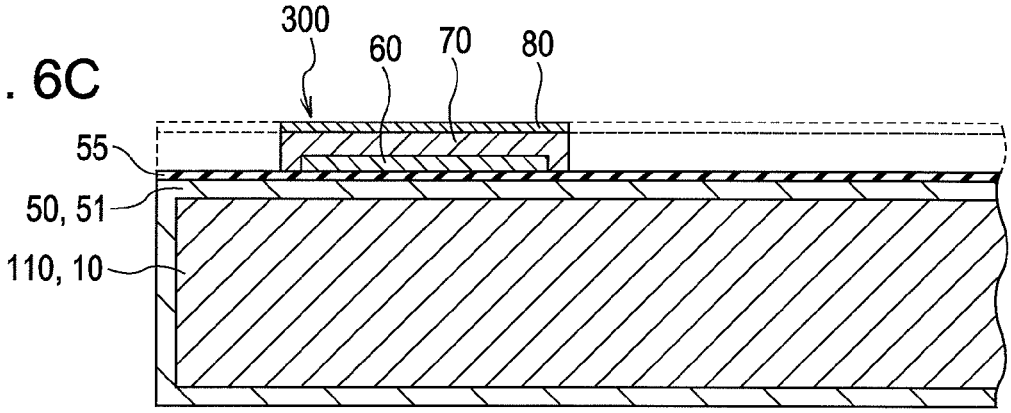

Next, as shown in FIG. 6B, a lower electrode film 60 is formed on the insulating film 55 and patterned into a particular shape. As shown in FIG. 6C, a piezoelectric film 70 composed of, for example, lead zirconate titanate (PZT) and an upper electrode film 80 are formed over the entire surface of the first wafer 110 and patterned to form piezoelectric elements 300 in regions opposing the pressure-generating chambers 12.

Figure 6D:
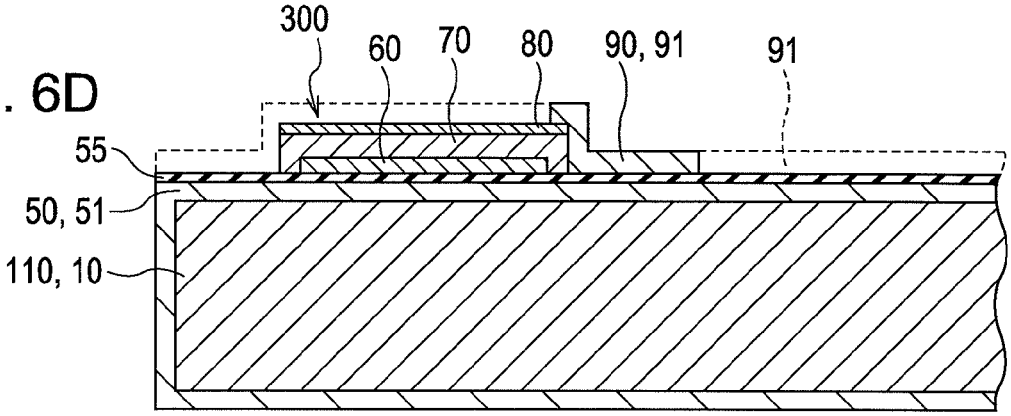

As shown in FIG. 6D, lead electrodes 90 are formed. In particular, a metal layer 91 is first formed over the entire surface of the first wafer 110 and then patterned to form lead electrodes 90 that respectively correspond to the piezoelectric elements 300.

Figure 7A:
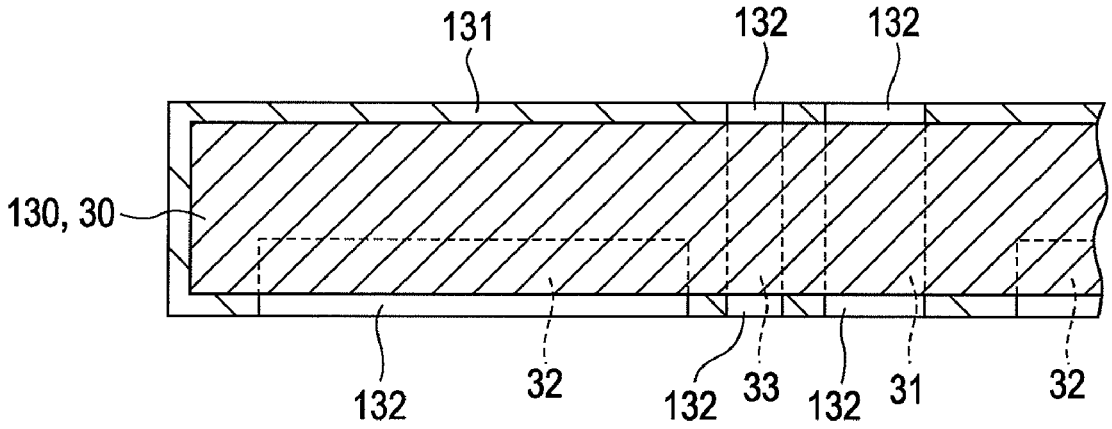
FIGS. 7A and 7B are cross-sectional views showing a manufacturing process according to one embodiment.

Reservoir portions 31, piezoelectric element holders 32, and through holes 33 are formed in the second wafer 130. First, as shown in FIG. 7A, a protective film 131 composed of, for example, silicon dioxide ($SiO_2$) is formed on a surface of the second wafer 130 and patterned to form openings 132 in regions where the reservoir portions 31, the piezoelectric element holders 32, and the through holes 33 are formed.

Figure 7B:
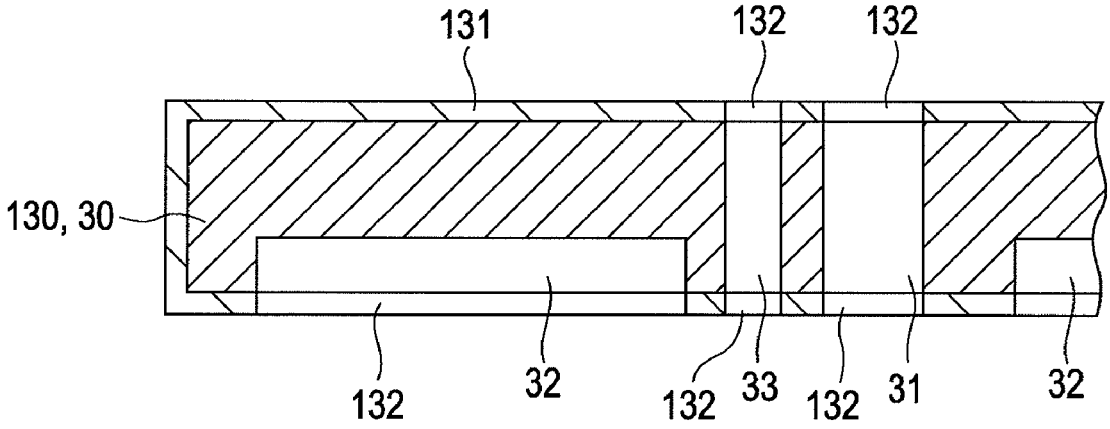

Next, the second wafer 130 is anisotropically etched with an etchant such as an aqueous potassium hydroxide (KOH) solution through the protective film 131 to simultaneously form the reservoir portions 31, the piezoelectric element holders 32, and the through holes 33, as shown in FIG. 7B. In this embodiment, the reservoir portions 31 and the through holes 33 are formed by anisotropically etching the second wafer 130 from both sides.

As described above, each reservoir portion 31 has a side surface 31*a* that extends in the longitudinal direction (the direction in which the pressure-generating chambers 12 are aligned). The side surface 31*a* is composed of a first (111) plane perpendicular to a (110) plane of the reservoir-forming substrate 30. The reservoir portion 31 also has a side surface 31*b* that extends in the width direction. The side surface 31*b* is composed of planes including a second (111) plane intersecting the first (111) plane. In other words, the reservoir portion 31 is formed by anisotropic etching so that the side surface 31*a* of the reservoir portion 31 extends in the direction orthogonal to the orientation flat 130*a* of the second wafer 130 (see FIG. 3B).

As a result, the shape of the side surface 31*a* of the reservoir portion 31 can be controlled highly accurately, and the position of the side surface 31*a* can be stabilized. Once the position of the side surface 31*a* which constitutes the major portion of the internal peripheral surface of the reservoir portion 31 is stabilized, i.e., once the dimensions of the reservoir portion 31 are stabilized, the yield can be significantly improved. Since the side surface 31*a* of the reservoir portion 31 is formed along the first (111) plane, there is no need to provide a correction pattern for forming the side surface 31*a* in the protective film 131. Thus, the chip-to-chip distance (the distance between reservoir-forming substrates 30) can be decreased, the number of chips produced from one wafer can be increased, and thus the cost can be reduced.

The side surface 31*b* of the reservoir portion 31 extending in the transverse direction is composed of planes including the second (111) plane. Thus, a correction pattern (not shown) needs to be provided to form the side surface 31*b* in the protective film 131. The correction pattern should be formed along the first (111) plane, i.e., the side surface 31*a*. Thus, the shape of the correction pattern can be relatively freely designed. Accordingly, the shape and the position of the side surface 31*b* can be controlled relatively accurately.

Figure 8A:
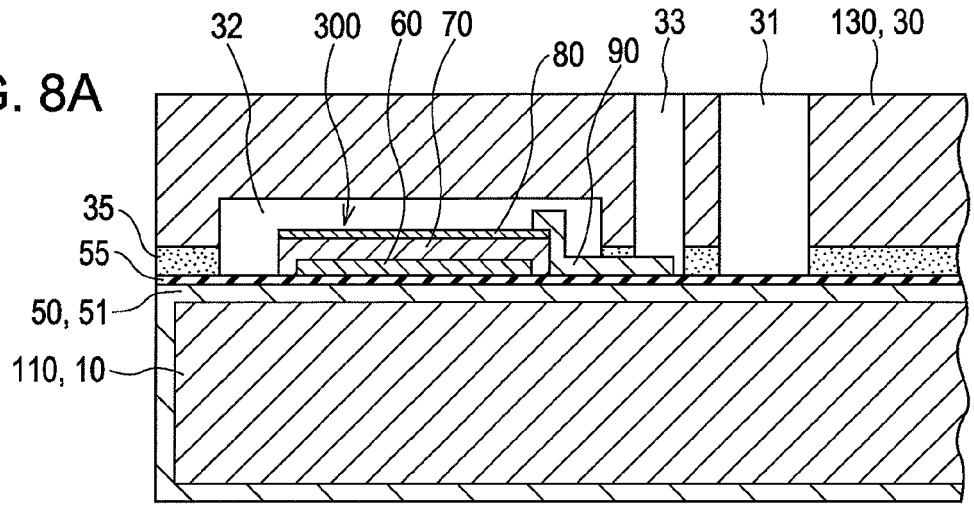
FIGS. 8A to 8C are cross-sectional views showing a manufacturing process according to one embodiment.
Figure 9A:
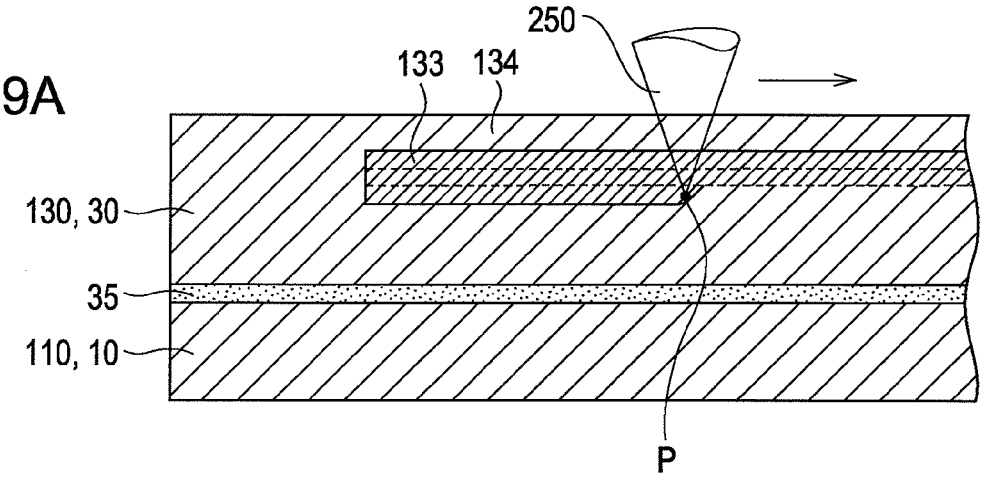
FIGS. 9A to 9C are schematic views showing a manufacturing process according to one embodiment.
Figure 9B:
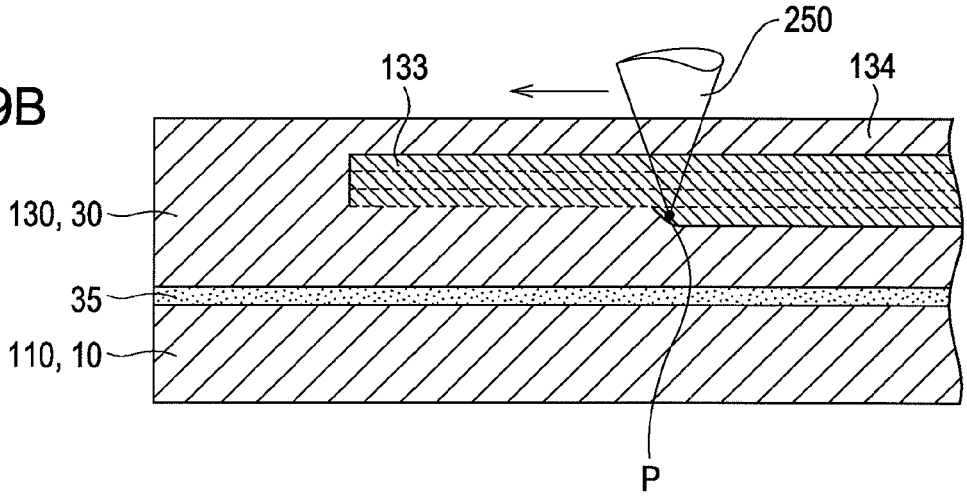
Figure 9C:
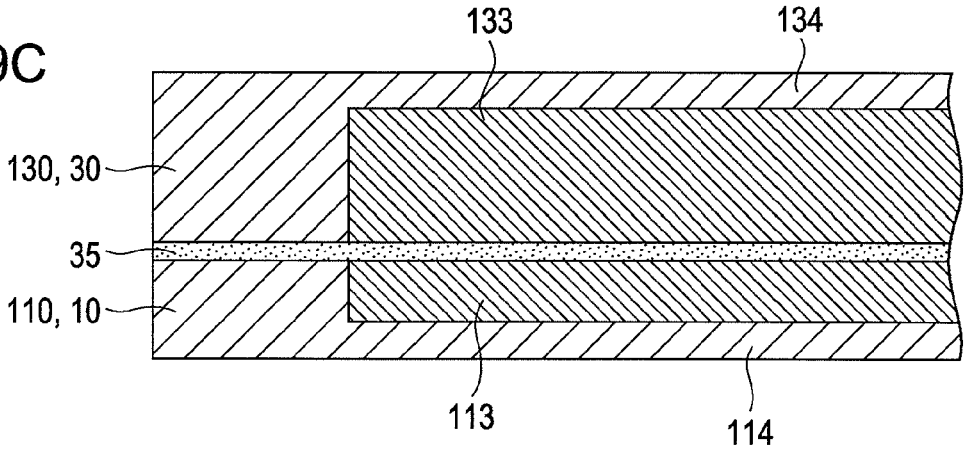

Next, as shown in FIG. 8A, the second wafer 130 with the reservoir portions 31 and associated parts formed therein is joined onto the piezoelectric element 300-side of the first wafer 110. In joining the second wafer 130 onto the first wafer 110, the orientation flats 110*a* and 130*a* are aligned. The method of joining the second wafer 130 onto the first wafer 110 is not particularly limited. For example, the second wafer 130 may be joined onto the first wafer 110 with an adhesive layer 35 composed of an epoxy-based adhesive or the like.

Figure 8B:
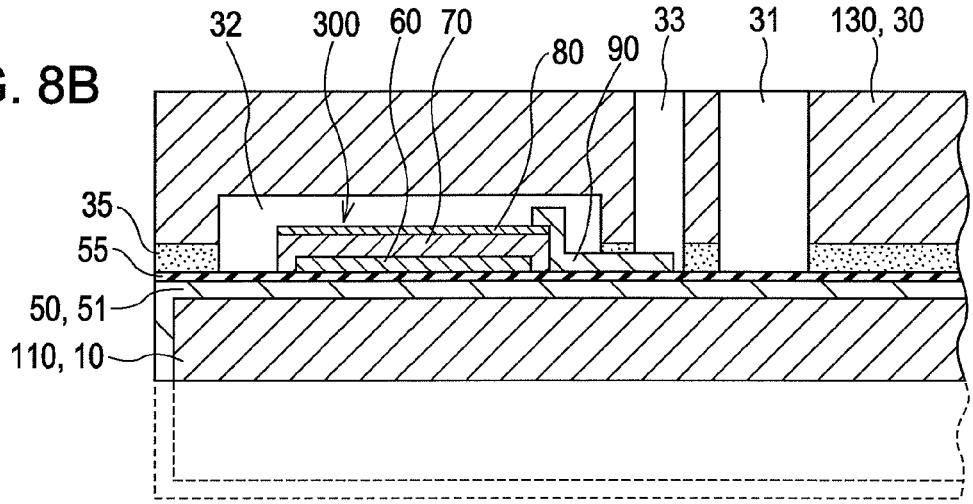
Figure 8C:
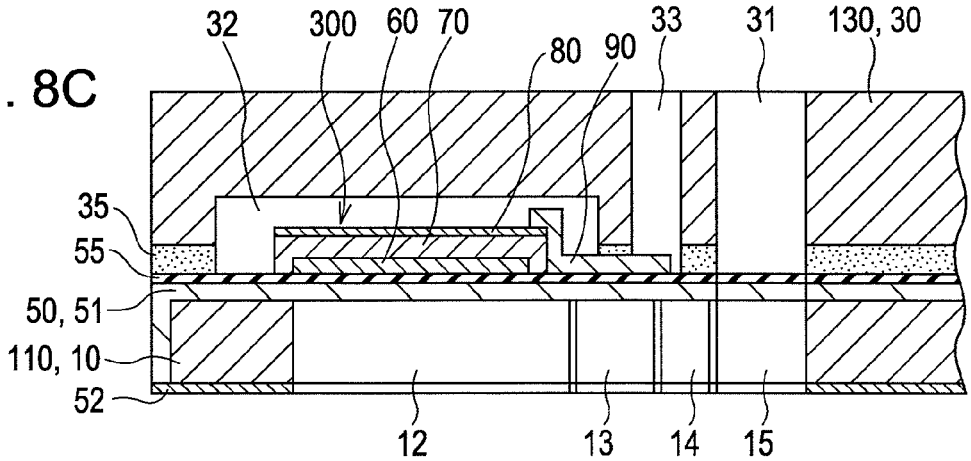

Next, as shown in FIG. 8B, the surface of the first wafer 110 remote from the second wafer 130 is processed to adjust the thickness of the first wafer 110 to a designed level. Then, as shown in FIG. 8C, a patterned protective film 52 that serves as a mask in forming ink flow channels such as pressure-generating chambers 12 and the like is formed on the surface of the first wafer 110. The first wafer 110 is anisotropically etched (wet-etched) while using the protective film 52 as a mask to form the pressure-generating chambers 12, the ink supply paths 13, the communication paths 14, and the communication portions 15 in the first wafer 110. In particular, the first wafer 110 is, for example, etched with an etchant such as an aqueous potassium hydroxide (KOH) solution until the elastic film 50 is exposed to form the pressure-generating chambers 12 and associated parts simultaneously. The elastic film 50 and the insulating film 55 are then removed to connect the communication portions 15 to the reservoir portions 31 to form reservoirs 100.

As described above, each pressure-generating chamber 12 has a side surface 12*a* that extends in the longitudinal direction and is composed of a first (111) plane perpendicular to a (110) plane of the reservoir-forming substrate 10. The pressure-generating chamber 12 also has a side surface 31*b* that extends in the width direction and is composed of a second (111) plane intersecting the first (111) planes. In other words, the pressure-generating chamber 12 is formed by anisotropic etching so that the side surface 12*a* of the pressure-generating chamber 12 extends in parallel with the orientation flat 110*a* of the first wafer 110 (see FIG. 5A).

Subsequently, although not shown in the drawing, a nozzle plate 20 is joined onto a surface of the first wafer 110, i.e., the surface at which the pressure-generating chambers 12 and associated parts lie open, and the compliance substrate 40 is joined onto the second wafer 130. The first wafer 110 and the second wafer 130 are then diced into chips, one of which is illustrated in FIG. 1, to prepare ink jet recording heads having the structure described above.

The flow channel-forming substrate 10 and the reservoir-forming substrate 30 of the ink jet recording head manufactured as such are both made of silicon single crystal substrates having a (110) plane orientation. However, the flow channel-forming substrate 10 differs from the reservoir-forming substrate 30 in the orientation of the first (111) planes. For example, in this embodiment, the direction of the first (111) plane of the flow channel-forming substrate 10 is orthogonal to the direction of the first (111) plane of the reservoir-forming substrate 30.

According to this arrangement, the rigidity of the flow channel-forming substrate 10 and the reservoir-forming substrate 30 as a whole is substantially improved, and the flow channel-forming substrate 10 and the reservoir-forming substrate 30 can be prevented from cracking. In other words, while silicon single crystal substrates are susceptible to cracking along the first (111) planes, the first (111) planes of the two substrates (flow channel-forming substrate 10 and reservoir-forming substrate 30) joined intersect each other. Thus, cracking along the first (111) planes can be prevented.

The method of dicing the first wafer 110 and the second wafer 130 is not particularly limited. Preferably, the first wafer 110 and the second wafer 130 are diced by applying a laser beam, as described below.

In particular, as shown in FIGS. 9A and 9B, a laser beam 250, such as a YAG laser beam, is applied onto the second wafer 130 and moved along the dicing lines 210 while being focused to a point P inside the second wafer 130. In other words, the laser beam 250 is focused to a point beneath the surface of the second wafer 130 under appropriate conditions to generate multiphoton absorption inside the second wafer 130 and to thereby form a fragile portion 133.

The fragile portion 133 is a region of the second wafer 130 that is reformed by the laser beam 250. For example, the fragile portion 133 may be a cracked region where a plurality of microcracks are present, or a melted region either in a molten state or a resolidified state. After formation of the fragile portion 133, the reservoir-forming substrates 30 in the second wafer 130 become connected to one another substantially through a connecting part 134 only. It should be noted that in forming the fragile portion 133, the fragile portion 133 may partly come off in some cases. This is not particularly problematic.

The fragile portion 133 is formed only in a region near the focal point, although this depends on various conditions such as output of the laser beam 250, the scanning rate, etc. As shown in FIGS. 9A and 9B, the same region on the dicing lines 210 is scanned several times with the laser beam 250 by altering the position of the focal point P in the thickness direction of the second wafer 130 to form the fragile portion 133.

Similarly, the first wafer 110 is irradiated with the laser beam 250 to form a fragile portion 113 along the dicing lines 200 of the first wafer 110 while leaving a connecting part 114 (see FIG. 9C).

After the fragile portions 113 and 133 (the connecting parts 114 and 134) are formed as such, the first wafer 110 and the second wafer 130 are diced along the dicing lines 200 and 210 along which the fragile portions 113 and 133 are formed. In other words, the flow channel-forming substrates 10 and the reservoir-forming substrates 30 are separated from the first wafer 110 and the second wafer 130 to form a plurality of ink jet recording heads. Since the fragile portions 113 and 133 are formed in the first wafer 110 and the second wafer 130, the flow channel-forming substrates 10 and the reservoir-forming substrates 30 can be separated by applying relatively small force.

The method of dicing the first wafer 110 and the second wafer 130 is not particularly limited. For example, external force may be applied onto the first wafer 110 and the second wafer 130 by using an expand ring or the like to separate the flow channel-forming substrates 10 and the reservoir-forming substrates 30. In such a case, the fragile portions 113 and 133 are preferably extended up to the outer periphery of the wafers.

As described above, since the fragile portions 113 and 133 are formed by irradiation with the laser beam 250, the flow channel-forming substrates 10 and the reservoir-forming substrates 30 can be satisfactorily separated by dicing the first wafer 110 and the second wafer 130 at the fragile portions 113 and 133. Moreover, the substrates can be separated in a desired direction irrespective of the crystal orientation of each substrate. Since the dicing width is significantly smaller than that of the case of forming a break pattern, the number of chips taken from one wafer can be further increased, resulting in further cost reduction.

Although the description above is directed to one embodiment, the invention is in no way limited to the embodiment described above.

For example, in the embodiment described above, the reservoir 100 is constituted by the communication portion 15 and the reservoir portion 31. However, the reservoir 100 may have any other appropriate structure. For example, the communication portion 15 of the flow channel-forming substrate 10 may be divided into a plurality of units corresponding to the pressure-generating chambers 12, and the reservoir 100 may be constituted from the reservoir portion 31 only. Alternatively, only the pressure-generating chambers 12 may be formed in the flow channel-forming substrate 10, a reservoir 100, constituted by a reservoir portion 31, and an ink supply path communicated with each pressure-generating chamber 12 may be formed in a component (e.g., elastic film 50, insulating film 55, or the like) interposed between the flow channel-forming substrate 10 and the reservoir-forming substrate 30 joined with each other. In this specification, the meaning of the word "join" includes that the two components are joined directly or with some other component therebetween.

Alternatively, the orientation flat of the first wafer 110 may extend along the (112) plane and the orientation flat of the second wafer 130 may extend along the (111) plane so that the parts having shapes rotated 90° from those shown in FIGS. 5A and 5B are formed.

Although the reservoir-forming substrate 30 is described above as one example of a joining substrate, the joining substrate is not limited to the reservoir-forming substrate. In other words, the invention achieves the above-described advantages as long as it involves a structure including a flow channel-forming substrate and a joining substrate to be jointed to the flow-channel-forming substrate.

In the embodiment described above, an ink jet recording head is described as an example of the liquid ejection head. However, the invention has a broad scope covering the entire genre of liquid ejection heads. The invention is naturally applicable to liquid ejection heads that eject liquids other than ink. Examples of other liquid ejection heads include various recording heads used in image recording apparatuses such as printers, coloring material ejecting heads used in making color filters of liquid crystal displays and the like, electrode material-ejecting heads used in forming electrodes of organic EL displays, field emission displays (FED), and the like, and bioorganic compounds-ejecting heads used in making biochips.

The entire disclosure of Japanese Patent Application No. 2008-035189, filed Feb. 15, 2008 is incorporated by reference herein.

What is claimed is:

1. A liquid ejection head comprising:

a flow channel-forming substrate having a plurality of pressure-generating chambers communicated with nozzles configured to eject droplets, the plurality of pressure-generating chambers being arranged in parallel with each other;

a plurality of pressure-applying units configured to apply pressure to interiors of the pressure-generating chambers; and a joining substrate joined onto one surface of the flow channel-forming substrate, wherein the flow channel-forming substrate includes a silicon single crystal substrate having a (110) plane orientation and has a side surface extending in a longitudinal direction of the pressure-generating chambers, the side surface being composed of a first (111) plane perpendicular to a (110) plane, and the joining substrate includes a silicon single crystal substrate having a (110) plane orientation and is joined onto the flow channel-forming substrate so that a first (111) plane of the joining substrate perpendicular to the (110) plane intersects the first (111) plane of the flow channel-forming substrate, wherein the first (111) plane of the joining substrate is orthogonal to the first (111) plane of the flow channel-forming substrate.

2. The liquid ejection head according to claim 1, wherein the joining substrate is a reservoir-forming substrate having a reservoir portion communicated with each of the plurality of pressure-generating chambers, the reservoir portion extending in a direction in which the pressure-generating chambers are arranged, and a side surface of the reservoir portion that extends in a longitudinal direction of the reservoir portion is composed of a second (111) plane perpendicular to the first (111) plane.

* * * * *